US005576677A

United States Patent [19]

Malingowski et al.

[11] Patent Number: 5,576,677

[45] Date of Patent: Nov. 19, 1996

[54] DUAL ACTION ARMATURE

[75] Inventors: Richard P. Malingowski, Union Township; Michael J. Erb, Franklin Township; Joseph F. Changle, Scott Township, all of Pa.

[73] Assignee: Eaton Corporation, Cleveland, Ohio

[21] Appl. No.: 481,717

[22] Filed: Jun. 7, 1995

[51] Int. Cl.[6] ..... H01H 9/00

[52] U.S. Cl. ..... 335/172; 335/167; 335/35

[58] Field of Search ..... 335/23–5, 35, 335/167–176

[56] References Cited

U.S. PATENT DOCUMENTS

| | | | |
|---|---|---|---|
| 3,936,780 | 2/1976 | Hennemann | 335/23 |
| 4,489,295 | 12/1984 | Altenhof, Jr. et al. . | |
| 4,503,408 | 3/1985 | Mrenna et al. . | |
| 4,638,277 | 1/1987 | Thomas et al. . | |
| 4,639,701 | 1/1987 | Shimp | 335/21 |
| 4,642,430 | 2/1987 | Tedesco . | |
| 4,656,444 | 4/1987 | McKee et al. . | |
| 4,679,018 | 7/1987 | McKee et al. . | |
| 4,691,182 | 9/1987 | Mrenna et al. . | |
| 4,698,606 | 10/1987 | Mrenna et al. . | |
| 4,725,800 | 2/1988 | Grunert et al. . | |
| 4,963,846 | 10/1990 | Grunert et al. . | |
| 5,293,522 | 3/1994 | Fello et al. . | |

*Primary Examiner*—Lincoln Donovan
*Attorney, Agent, or Firm*—Martin J. Moran

[57] ABSTRACT

A circuit breaker includes a housing having an opening; separable contacts disposed within the housing and moveable between a closed position and an open position; an operating mechanism having a trip position where the separable contacts are tripped open for moving the separable contacts between the closed and open positions; a trip mechanism cooperating with the operating mechanism for tripping the operating mechanism to the trip position; an electromagnetic mechanism cooperating with the trip mechanism for sensing a current flowing between the separable contacts and engaging the trip mechanism with an armature in response to a predetermined current flowing between the separable contacts; and a manual push-to-trip mechanism operatively associated with the opening of the housing and cooperating with the electromagnetic mechanism for engaging the armature thereof, in order to engage the trip mechanism, trip the operating mechanism to the trip position, and trip open the separable contacts.

14 Claims, 4 Drawing Sheets

DUAL ACTION ARMATURE

BACKGROUND OF THE INVENTION

1. Field of the Invention

This invention is directed to electrical circuit breakers, and more particularly to electrical circuit breakers which include a manual mechanism for tripping the circuit breaker.

2. Background Information

Circuit breakers are generally well-known in the art. Examples of molded case circuit breakers are disclosed in U.S. Pat. Nos. 4,698,606; 4,725,800; and 4,963,846. Circuit breakers are used to protect electrical circuitry from damage due to an overcurrent condition, such as an overload condition or a relatively high level short circuit condition.

Molded case circuit breakers include at least one pair of separable contacts which generally may be operated manually by way of an operating handle disposed on the outside of the case or automatically in response to an overcurrent condition. When the circuit breaker is on, a movable contact assembly is in contact with a stationary or fixed contact assembly. The closed contacts conduct a flow of current between a line terminal and a load terminal. When the circuit breaker trips or is switched off, the movable contact assembly is moved away from the fixed contact assembly, thus, interrupting the flow of current between the line and load terminals.

Circuit breakers generally include a pivoting operating handle, which projects through an opening formed in the breaker housing, for normal on/off manual operation. The operating handle generally assumes three or more positions during operation of the circuit breaker. When the handle is moved to the ON position, and the breaker is not tripped, the contacts of the circuit breaker close, thereby allowing electrical current to flow between a current source and an associated electrical circuit. When the handle is moved to the OFF position, the contacts of the circuit breaker open, thereby preventing current from flowing through the circuit breaker. When the circuit breaker trips, and the separable contacts thereof are opened, the handle moves to a TRIP position between the ON and OFF positions.

Molded case circuit breakers have mounted within their housing an operating mechanism and a trigger or latching assembly which, under normal conditions, latches the operating mechanism operatively coupled to one or more main contacts. The operating mechanism of the circuit breaker is designed to rapidly open and close the separable contacts, thereby preventing a moveable contact from stopping at any position which is intermediate a fully open or fully closed position. Actuation of the latching assembly unlatches the operating mechanism which causes the contacts to separate, thereby interrupting the flow, of current through the circuit breaker between the line and load terminals.

Some types of circuit breakers include an electro-mechanical trip unit which interrupts current flow in two or more modes of operation. The electro-mechanical trip unit generally senses overload currents of up to about five to six times normal rated current as well as short circuit currents of greater than about ten times normal rated current. A bimetal member is disposed in series with the separable contacts. In the first mode of operation, with the occurrence of an overload current, the bimetal member is heated. In turn, the bimetal member deflects and engages a flange of a trip bar, thereby rotating the trip bar and tripping the circuit breaker. An electromagnet is also disposed in series with the separable contacts as part of the electrically conductive path between the line and load terminals. In the second mode of operation of the electro-mechanical trip unit, in response to a short circuit current, the electromagnet is energized and electromagnetically attracts the armature thereto. In turn, the armature rotates and engages another flange of the trip bar, thus, rotating the trip bar and tripping the circuit breaker.

It is known to electrically interconnect an external shunt trip mechanism, ground fault trip mechanism or undervoltage trip relay with an internal solenoid of the circuit breaker. Whenever this solenoid is energized, a plunger thereof drives the armature of the electro-mechanical trip unit in order to trip the circuit breaker.

Other types of circuit breakers may include an electronic trip unit for automatically interrupting the current flow. The electronic trip unit includes current sensors or transformers which respond to an overcurrent condition. When the overcurrent condition is sensed, the current sensors provide a signal to the electronic circuitry within the electronic trip unit which energizes a solenoid. In turn, a plunger of the solenoid engages a flange of the trip bar which rotates, unlatches the operating mechanism and trips the circuit breaker. It is also known to drive the armature of the electro-mechanical trip unit with the plunger of the solenoid in order to trip the circuit breaker.

Circuit breakers may also include a manual pushbutton for manually interrupting the current flow. Whenever the pushbutton is pressed, a plunger associated with the pushbutton engages a flange of the trip bar. This flange rotates the trip bar, thereby unlatching the operating mechanism and tripping the circuit breaker. The manual pushbutton facilitates partial testing of the trip mechanism. The manual pushbutton, also, provides for a relatively rapid manual trip operation under emergency conditions in comparison to the normal manual ON to OFF operation with the operating handle. However, there is room for improvement of the manual pushbutton.

There is a need, therefore, for a manual trip mechanism which facilitates additional testing of the circuit breaker.

There is a more particular need for such a mechanism that facilitates such testing without significantly decreasing the reliability of the manual trip mechanism.

There is another need for a mechanism which provides manual trip with minimal modification of an existing circuit breaker.

There is a more particular need for such a mechanism that provides manual trip with minimal cost.

SUMMARY OF THE INVENTION

These and other needs are satisfied by the invention which is directed to a circuit breaker including a housing having an opening; separable electrical contacts disposed within the housing and moveable between a closed position and an open position; an operating mechanism for moving the separable electrical contacts between the closed position and the open position, the operating mechanism having a trip position wherein the separable electrical contacts are tripped open; a trip mechanism cooperating with the operating mechanism for tripping the operating mechanism to the trip position; an automatic mechanism cooperating with the trip mechanism for sensing an electrical condition of the separable electrical contacts and engaging the trip mechanism in response to a predetermined electrical condition of the separable electrical contacts; and a manual mechanism operatively associated with the opening of the housing and cooperating with the automatic mechanism for engaging the automatic mechanism, in order to engage the trip mechanism, trip the operating mechanism to the trip position, and trip open the separable electrical contacts.

Alternatively, a circuit breaker includes a separable contact mechanism moveable between a closed position and an open position; an operating mechanism for moving the separable contact mechanism between the closed position and the open position, the operating mechanism having a trip position wherein the separable contact mechanism is tripped open; a trip mechanism cooperating with the operating mechanism for tripping the operating mechanism to the trip position; an automatic mechanism cooperating with the trip mechanism for sensing an electrical condition of the separable contact mechanism, the automatic mechanism including an armature mechanism for engaging the trip mechanism in response to a predetermined electrical condition of the separable contact mechanism; and a manual mechanism including a pushbutton mechanism and an engaging mechanism, the pushbutton mechanism for manually moving the engaging mechanism, the engaging mechanism for engaging the armature mechanism in order to engage the trip mechanism, trip the operating mechanism to the trip position, and trip open the separable contact mechanism.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

A typical example of a circuit breaker with a magnetic trip circuit is disclosed in U.S. Pat. No. 4,503,408 issued Mar. 5, 1985, which is herein incorporated by reference. As used herein, reference numbers up to and including 101 correspond, except as noted below, to the same such reference numbers in U.S. Pat. No. 4,503,408.

Figure 1:
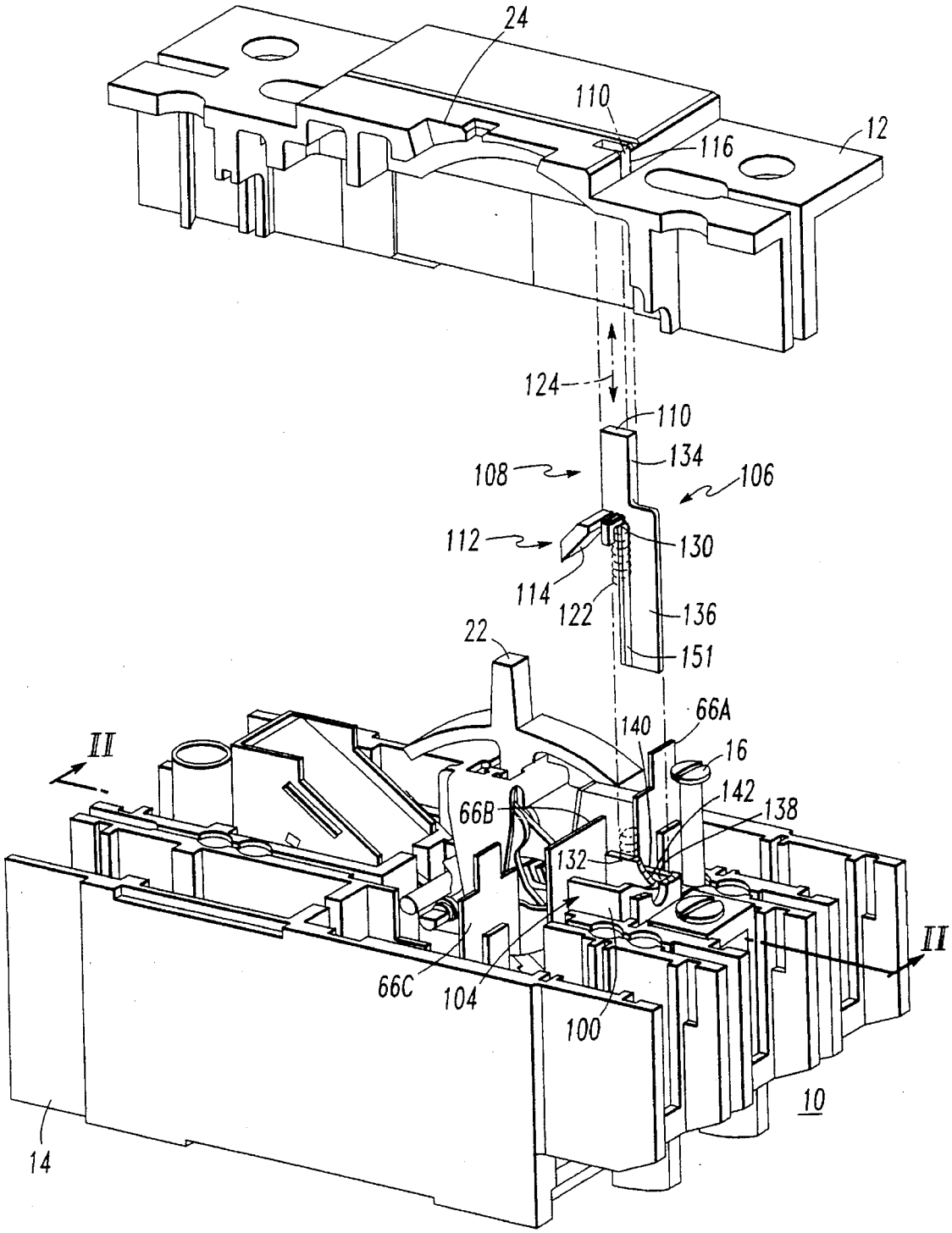
FIG. 1 is an exploded isometric view, with some parts cut-away, of a multi-pole circuit breaker in accordance with the invention.
Figure 2:
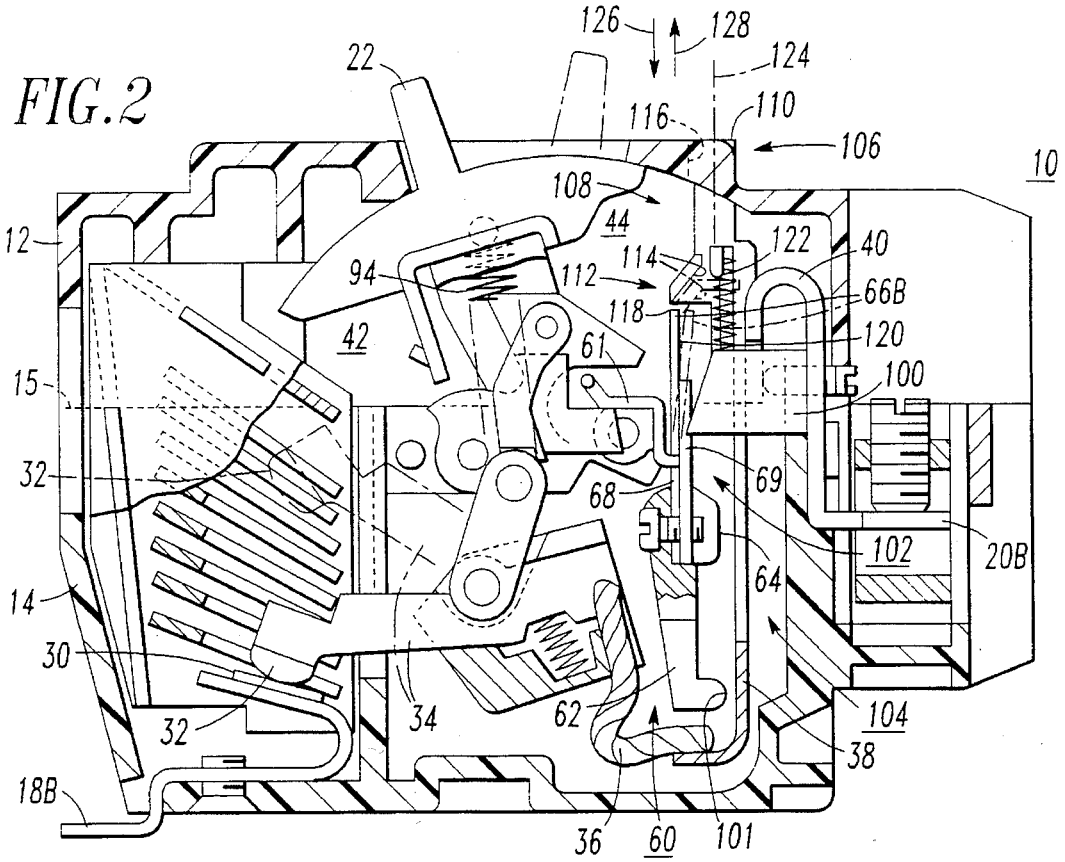
FIG. 2 is a vertical sectional view taken along lines II—II of FIG. 1 with the operating mechanism in the CLOSED position.
Figure 3:
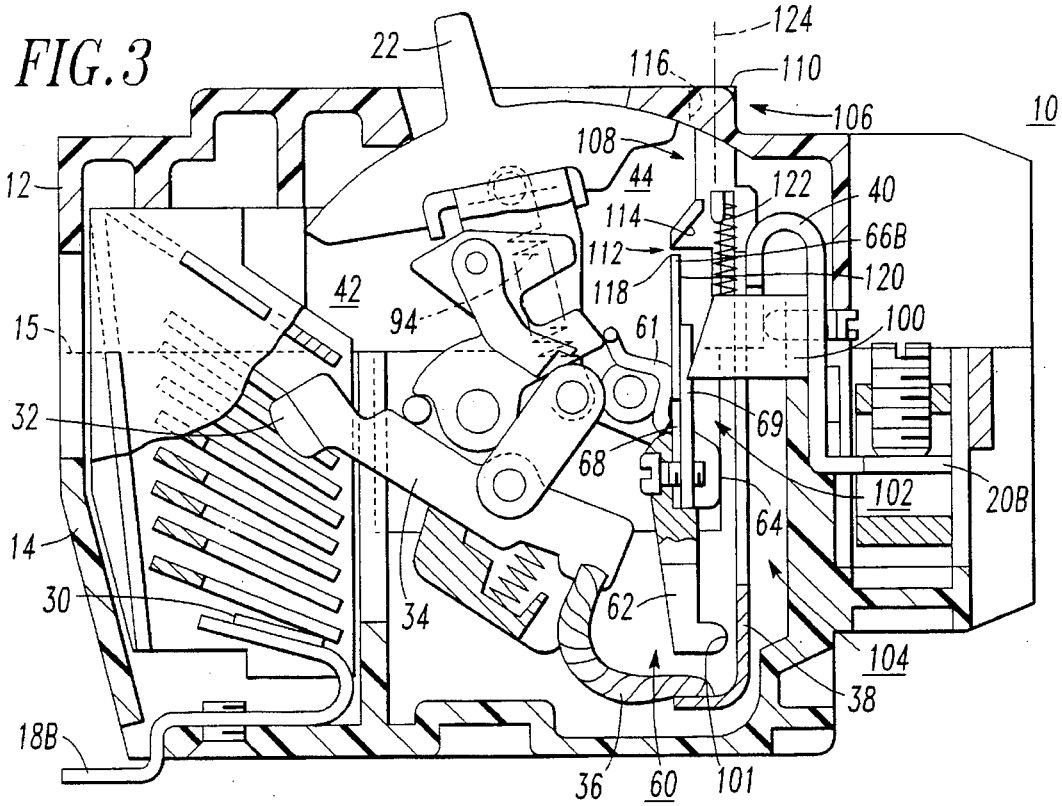
FIG. 3 is a vertical sectional view similar to that of FIG. 2 with the operating mechanism in the TRIP position.

Referring now to FIGS. 1–3, a three phase molded case circuit breaker 10 is shown, although the invention is applicable to circuit breakers having any number of phases. The circuit breaker 10 includes an electrically insulatably molded front cover 12 which is joined to a similar molded base 14 at an interface 15 (shown in FIGS. 2–3) and is secured thereto by way of screws 16 (only one is shown in FIG. 1). The circuit breaker 10 also includes three line terminals of which only line terminal 18B for the second of the three phases is shown in FIGS. 2 and 3. Correspondingly, the circuit breaker 10 further includes three collar assembly terminals of which only terminal 20B, which corresponds to the line terminal 18B, is shown in FIGS. 2 and 3. The circuit breaker also includes a handle 22 which is movable in an opening 24 (partially shown in FIG. 1) in the front cover 12.

Continuing to refer to FIGS. 2–3, the line terminal 18B is interconnected with a fixed internal contact 30. A movable contact 32 is movably operable to be placed into or out of a disposition of electrical continuity with the corresponding fixed contact 30 depending upon the status of an operating mechanism 44. As shown in FIG. 2, electrical continuity between the line terminal 18B and the collar assembly 20B is provided by way of the fixed contact 30, the movable contact 32 when closed against the fixed contact 30, a movable contact arm 34, a flexible conductor 36, a bimetal 38 and a lower contact extension 40. A support assembly 42 supports portions of the operating mechanism 44 which in turn cooperates with a trip bar assembly 60 and an intermediate latch 61 to cause the separation and joining of the separable electrical contacts 30,32 in response to the status of electrical current flowing between the terminals 18B,20B or the manual disposition of the handle 22.

The operating mechanism 44 is shown, in FIG. 2, in the CLOSED position and, also, in FIG. 3, in the TRIPPED position of the separable contacts 30,32. FIG. 2 also shows the separable contacts 30,32 (in phantom line drawing) in the OPEN position thereof. The operating mechanism 44 moves the separable electrical contacts 30,32 between these CLOSED and OPEN positions. As shown in FIG. 3, the operating mechanism 44 has a TRIP position wherein the separable electrical contacts 30,32 are tripped open.

Continuing to refer to FIG. 3, in the TRIP position, either an electromagnet device 100 or the bimetal 38 has caused a previous rotational movement of the trip bar assembly 60 in the clockwise direction in order to allow the intermediate latch 61 to be free of a lock member 69 of the trip bar assembly 60 and cause rotation of the intermediate latch 61 to the disposition shown in FIG. 3. This, as further discussed in U.S. Pat. No. 4,503,408, disengages the movable contact 32 from the fixed contact 30 and interrupts the current flowing between the terminals 18B,20B. As shown in the CLOSED position of FIG. 2, either an electromagnetic energization of the electromagnet 100 or an electrothermal energization of the bimetal 38 causes an unlatching or tripping of the operating mechanism 44.

Referring again to FIG. 2, the exemplary trip bar assembly 60 includes three trip bars 62 (only one is shown), one for each of the phases, and a common trip bar axle 64. The exemplary circuit breaker 10 includes three magnetic armature members 66A,66B,66C (as shown in FIG. 1), one for each of the phases. The armature 66B of FIG. 2 (which is referred to as armature 66 in U.S. Pat. No. 4,503,408) is associated with the terminals 18B,20B. The armature 66B is flexibly attached to the trip bar axle 64 by way of a flexible attachment member 68 which may be formed from sheet spring steel or a similar material. The flexible attachment member 68 and the attached armature 66B flex relative to the remainder of the trip bar assembly 60 for purposes which will be described hereinafter.

The arrangement of the operating mechanism 44 is such that the handle 22 is maintained in the ON position and the movable contact 32 is maintained in the CLOSED position by the cooperation of the intermediate latch 61 and the trip bar assembly 60. The intermediate latch 61 is caught or captured by the trip bar assembly lock member 69 and held in that disposition by the compressive action of a spring 94 operating on the handle 22. As further discussed in U.S. Pat. No. 4,503,408, rotational movement of the trip bar assembly 60 in the clockwise direction allows for similar rotational movement of the intermediate latch 61 under the influence of the spring 94 and, in turn, causes opening (as shown in FIG. 3) of the movable contact 32 in an appropriate trip situation.

Referring again to FIG. 3, the TRIP position of the operating mechanism 44 may be brought about by the energization of the electromagnet 100, which is part of the electrically conductive path between the collar 20B and the bimetal 38, and which, in turn, electromagnetically influences the armature 66B of FIGS. 2–3, thus causing rotation of the trip bar assembly 60. The trip bar assembly 60 may also be rotated clockwise by the heating of the bimetal 38 due to a persistent electrical overcurrent therein. The bimetal 38 then impinges upon a tip 101 of the trip bar 62, causing clockwise rotation of the trip bar assembly 60 and, thus, freeing the intermediate latch 61 as described previously.

The trip bar assembly 60 and the intermediate latch 61 form a trip mechanism 102 which cooperates with the operating mechanism 44 for tripping the operating mechanism 44 to the TRIP position. The bimetal 38, the electromagnet 100 and the moveable armature 66B form an automatic mechanism 104 which cooperates with the trip mechanism 102 for sensing an overcurrent condition of the separable electrical contacts 30,32 and engaging the trip bar assembly 60 in response to predetermined electrical conditions of the contacts 30,32.

In the exemplary embodiment, the bimetal 38 is selected in order to engage the tip 101 of the trip bar 62, rotate the trip bar assembly 60 and, thus, trip the operating mechanism 44 to the TRIP position due to a persistent electrical overcurrent of about five to six times the normal rated current of the circuit breaker 10. The exemplary electromagnet 100, which senses current flowing between the separable electrical contacts 30,32, and the exemplary armature 66B are selected in order to electromagnetically attract the armature 66B which engages the lock member 69 and rotates the trip bar assembly 60. In turn, the operating mechanism 44 is tripped to the TRIP position thereof due to a short circuit electrical current of about ten times the normal rated current of the circuit breaker 10.

Referring again to FIGS. 1–3, the circuit breaker 10 further includes a manual push-to-trip mechanism 106 which cooperates with the automatic mechanism 104 in order to engage the trip mechanism 102, trip the operating mechanism 44 to the TRIP position, and trip open the separable electrical contacts 30,32. The exemplary manual mechanism 106 includes a pushbutton mechanism 108 having an operating surface 110 accessible from exterior to the circuit breaker 10 and an engaging mechanism 112 having an engaging surface 114 interior to the circuit breaker 10. The operating surface 110 of the pushbutton mechanism 108 is accessible from outside of the circuit breaker 10 through an opening 116 in the cover 12. Preferably, the operating surface 110 is flush or slightly recessed with respect to the outside of the cover 12. The engaging mechanism 112 engages the automatic mechanism 104 within the circuit breaker 10.

Whenever the operating surface 110 is manually depressed, the manual mechanism 106 moves downwardly with respect to FIG. 2. In this manner, the pushbutton mechanism 108 manually moves the engaging mechanism 112 and, hence, the engaging surface 114 thereof engages an edge 118 of the armature 66B (as shown in phantom line drawing in FIG. 2). The movable armature 66B includes a surface 120 which generally faces the electromagnet 100.

The pushbutton mechanism 108, which is biased upwardly with respect to FIG. 2 by a compression spring 122, generally has a longitudinal axis 124 and is manually movable from the initial position of FIG. 2 in a downward linear direction 126. In turn, the pushbutton mechanism 108 moves downwardly along the longitudinal axis 124 and causes the engaging mechanism 112 to engage the movable armature 66B (as shown in phantom line drawing in FIG. 2).

The surface 114 of the engaging mechanism 112 is generally oblique with respect to the longitudinal axis 124 of the pushbutton mechanism 108. The surface 114 engages the edge 118 of the armature 66B (as shown in phantom line drawing in FIG. 2), thereby engaging the automatic mechanism 104. The armature 66B and the surface 120 thereof are initially about parallel with respect to the longitudinal axis 124 of the pushbutton mechanism 108. The edge 118 of the armature 66B is about transverse with respect to the longitudinal axis 124. Downward movement of the pushbutton mechanism 108 along the longitudinal axis 124 thereof moves the engaging mechanism 112 which engages the surface 114 thereof with the edge 118 of the armature 66B. In turn, as described in greater detail in U.S. Pat. No. 4,503,408, the armature 66B causes a clockwise rotation (with respect to FIG. 2) of the trip bar assembly 60. The trip bar assembly axle 64 is about transverse with respect to the longitudinal axis 124 of the pushbutton mechanism 108. In this manner, the pushbutton mechanism 108 at least partially rotates the armature 66B about the trip bar axle 64 which, in turn, at least partially rotates in order to trip the circuit breaker 10.

Figure 4:
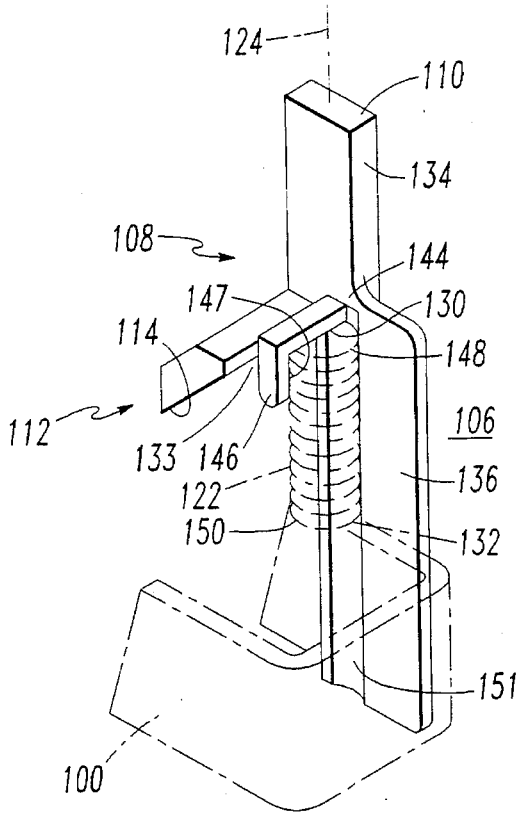
FIG. 4 is an isometric view of a trip pushbutton in accordance with an embodiment of the invention.

As shown in FIGS. 1 and 4, the compression spring 122 of the manual push-to-trip mechanism 106 is biased between a surface 130 of the pushbutton mechanism 108 and a surface 132 of the electromagnet 100 which is supported by the base 14. The surface 130 is about transverse with respect to the longitudinal axis 124 of the pushbutton mechanism 108. The spring 122 normally biases the pushbutton mechanism 108 away from the armature 66B and toward the outside of the cover 12 of FIG. 1.

Figure 7:
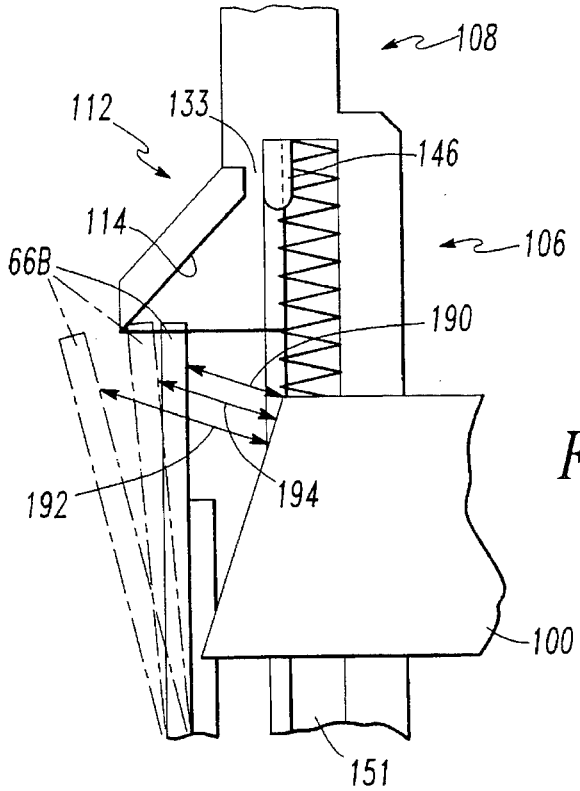
FIG. 7 is a side view of the trip pushbutton and the armature in accordance with the invention.

Continuing to refer to FIG. 2, during push-to-trip operation of the manual mechanism 106, after an operator presses the operating surface 110, moves the pushbutton mechanism 108 downwardly (to the position shown in phantom line drawing), and releases the operating surface 110, the spring 122 returns the pushbutton mechanism 108 upwardly in the linear direction 128 to the initial position of FIG. 2. As discussed above, the exemplary surface 114 of the engaging mechanism 112 forms a ramp which slides on the edge 118 of the armature 66B during the push-to-trip operation. In turn, this ramp produces an angular displacement of the armature 66B about the axis of the trip bar axle 64 as a function of the geometry of the ramp and the depth of depression of pushbutton mechanism 108, thereby rotating the trip bar assembly 60. As shown in FIGS. 4 and 7, a slot 133 between the surface 114 of the engaging mechanism 112 and the tab 146 of the pushbutton mechanism 108 accommodates any overtravel of the armature 66B during a push-to-trip operation.

Preferably, the exemplary spring 122 is made of stainless steel in order to minimize thermal conduction and magnetic effects, such as eddy currents, associated with the electromagnet 100, although other compressive materials may be used. Preferably, the pushbutton and engaging mechanisms 108,112 are made of a thermal plastic, such as, for example, VALOX 420 SEO, although other plastic materials may be used.

Also referring to FIG. 4, the exemplary pushbutton mechanism 108 includes two arms 134,136 which are disposed along the longitudinal axis 124. The arm 134 is upwardly disposed and is accessible through the opening 116 of the cover 12 of FIG. 2. As shown in FIG. 1, the arm 136 is downwardly disposed within a recess 138 formed by an internal wall 140 of the base 14 and a side 142 of the electromagnet 100.

Continuing to refer to FIG. 4, the arms 134,136 are joined at a common cross member 144 and are generally upwardly and downwardly mobile along the longitudinal axis 124. A tab portion 146 is downwardly disposed from the surface 130 of the pushbutton mechanism 108. One end 148 of the spring 122 (shown in phantom line drawing) is disposed between the tab portion 146 and the arm 136. The upward end 148 of the exemplary spring 122 is biased by the surface 130 of the pushbutton mechanism 108. The downward end 150 of the spring 122 is biased by the surface 132 of the electromagnet 100 (shown in phantom line drawing). The spring 122 is also retained by a channel 151 of the arm 136. The channel 151 has a radius about equal to the radius of the spring 122. The spring 122 is further retained by a radius (not shown) on a side 147 of the tab portion 146.

Figure 5:
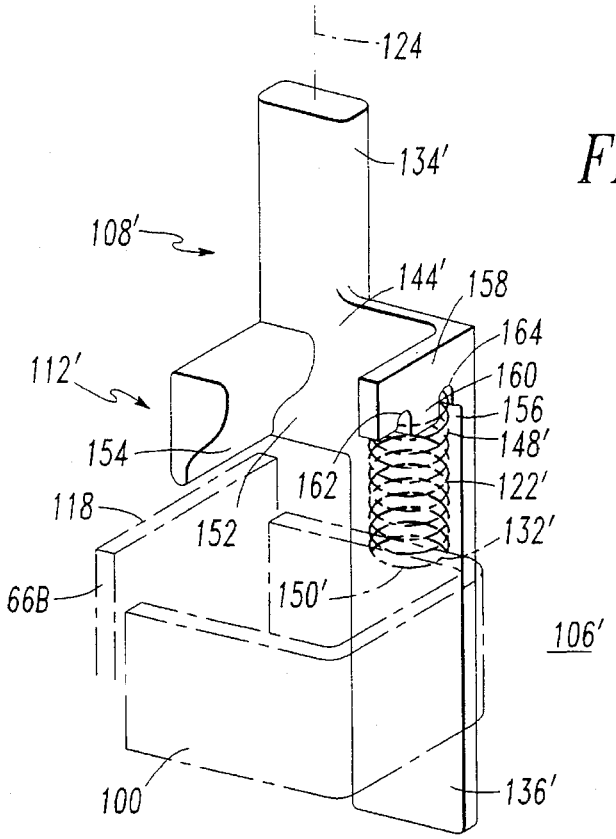
FIG. 5 is an isometric view of a trip pushbutton in accordance with an alternative embodiment of the invention.

FIG. 5 illustrates an alternative manual push-to-trip mechanism 106' which includes a pushbutton mechanism 108' and an engaging mechanism 112'. The pushbutton mechanism 108' has two arms 134',136' which are joined at a common cross member 144'. Except as described below, the manual push-to-trip mechanism 106' is generally similar to the mechanism 106 of FIG. 4. The engaging mechanism 112' is transversely disposed with respect to the longitudinal axis 124 at one end 152 of the cross member 144' and includes a generally arcuate surface 154 for engaging the edge 118 of the armature 66B (shown in phantom line drawing). Transversely disposed, with respect to the longitudinal axis 124, from the other end 156 of the cross member 144' is a member 158. The member 158 includes a tab portion 160 which is downwardly disposed between two notches 162,164. In this embodiment, one end 148' of a spring 122' (shown in phantom line drawing) is disposed about the tab portion 160 and within the notches 162,164. The upward end 148' of the spring 122' is biased by the member 158 of the pushbutton mechanism 108'. The downward end 150' of the spring 122' is biased by the surface 132' of the electromagnet 100 (shown in phantom line drawing).

Figure 6:
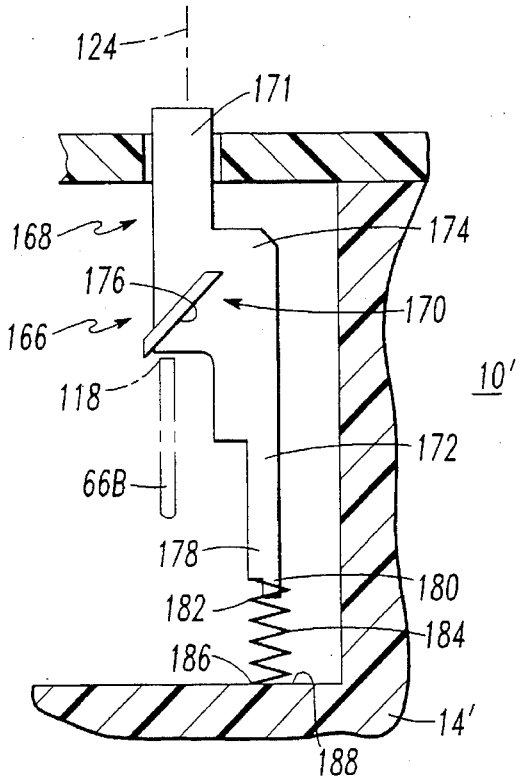
FIG. 6 is a side view of a circuit breaker with a trip pushbutton in accordance with another alternative embodiment of the invention.

FIG. 6 illustrates another circuit breaker 10', similar to the circuit breaker 10 of FIG. 2, with an alternative manual push-to-trip mechanism 166 which includes a pushbutton mechanism 168 and an engaging mechanism 170. The pushbutton mechanism 168 has two arms 171,172 which are joined at a common cross member 174. Except as described below, the manual push-to-trip mechanism 166 is generally similar to the mechanism 106 of FIG. 4. The engaging mechanism 170 is transversely disposed with respect to the longitudinal axis 124 and includes an oblique surface 176 for engaging the edge 118 of the armature 66B (shown in phantom line drawing). Downwardly disposed, with respect to the longitudinal axis 124, from the downward end 178 of the arm 172 is a tab portion 180. In this embodiment, one end 182 of a spring 184 is disposed about the tab portion 180. The upward end 182 of the spring 184 is biased by the arm 172 of the pushbutton mechanism 168. The downward end 186 of the spring 184 is biased by a surface 188 of a base 14' of the circuit breaker 10'.

Referring to FIG. 7, a side view of the push-to-trip mechanism 106, armature 66B and electromagnet 100 of FIG. 2 is illustrated. Also referring to FIG. 2, the armature 66B and the electromagnet 100 generally have a nominal spacing 190 therebetween whenever about zero current flows between the separable electrical contacts 30,32. As discussed above with FIG. 2, prior to the push-to-trip operation of the pushbutton mechanism 108, the engaging mechanism 112 normally does not engage the armature 66B.

However, under normal manufacturing tolerances, the nominal spacing 190 may increase (as shown by the exemplary spacing 192 in phantom line drawing). Under such tolerances which result in the spacing 192, the electromagnet 100 and armature 66B require a relatively larger value of short circuit electrical current than the exemplary about ten times normal rated current of the circuit breaker 10 in order to trip the operating mechanism 44 to the TRIP position. In such case where the manufacturing tolerances result in the spacing 192, the circuit breaker 10 is assembled such that the surface 114 of the engaging mechanism 112 normally engages the armature 66B. This sets the spacing of the armature 66B to within about a generally predetermined spacing 194 from the electromagnet 100. In this manner, by limiting the spacing between the armature 66B and the electromagnet 100 to the generally predetermined spacing 194, as contrasted with the relatively larger spacing 192 when there is no push-to-trip mechanism 106, the normal manufacturing variation of the generally predetermined value of short circuit electrical current which trips the circuit breaker 10 is more closely controlled.

In the case of the spacing 192, the push-to-trip operation of the manual mechanism 106 further engages the armature 66B with the surface 114 of the engaging mechanism 112. Regardless of which one of the spacings 190,192,194 applies, the armature 66B is movable toward the electromagnet 100 by electromagnetic attraction which is independent of the push-to-trip mechanism 106. As will be understood by those skilled in the art, the exemplary spacing 194 is also provided by the push-to-trip mechanism 106' of FIG. 5 and the push-to-trip mechanism 166 of FIG. 6.

The exemplary push-to-trip mechanisms 106,106', 166 disclosed herein ensure that the armature 66B is maintained within the spacing 194 of the electromagnet 100. Under nominal manufacturing tolerances, as shown by the exemplary spacing 190, the surfaces 114, 154, 176 of the respective engaging mechanisms 112, 112', 170 do not engage the edge 118 of the armature 66B prior to the push-to-trip operation and, conversely, normally only engage this edge 118 during the push-to-trip operation. Under other manufacturing tolerances (e.g., as shown by the exemplary spacings 192,194), the surfaces 114,154,176 of the respective engaging mechanisms 112,112',170 engage the edge 118 of the armature 66B prior to (and during) the push-to-trip operation in order to maintain the minimum spacing 194.

The exemplary push-to-trip mechanisms 106,106',166 further provide an additional mechanical test of the armature 66B with respect to prior known push-to-trip mechanisms which engage a flange of a trip bar. The exemplary mechanisms 106,106', 166 also provide additional leverage, with respect to prior known push-to-trip mechanisms, by engaging the end of the armature 66B which is relatively longer than the prior known trip bar flanges. The exemplary mechanisms 106,106',166 further provide the benefit of a manual push-to-trip mechanism which may be incorporated within a circuit breaker with minimum modification thereof.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker, comprising:

a housing having an opening;

separable electrical contacts disposed within said housing and moveable between a closed position and an open position;

operating means for moving said separable electrical contacts between the closed position and the open position, said operating means having a trip position wherein said separable electrical contacts are tripped open;

trip means cooperating with said operating means for tripping said operating means to the trip position;

automatic means cooperating with said trip means for sensing an electrical condition of said separable electrical contacts and engaging said trip means in response to a predetermined electrical condition of said separable electrical contacts;

manual means operatively associated with the opening of said housing and cooperating with said automatic means for engaging said automatic means, in order to engage said trip means, trip said operating means to the trip position, and trip open said separable electrical contacts;

wherein said automatic means includes a movable armature which engages said trip means includes engaging means for engaging the movable armature; and wherein said manual means further includes pushbutton means having a longitudinal axis, wherein the pushbutton means moves along the longitudinal axis thereof in order to engage the movable armature, and wherein the engaging means has a surface which is generally oblique with respect to the longitudinal axis, the oblique surface for engaging the movable armature.

2. A circuit breaker, comprising:

a housing having an opening;

separable electrical contacts disposed within said housing and moveable between a closed position and an open position;

operating means for moving said separable electrical contacts between the closed position and the open position, said operating means having a trip position wherein said separable electrical contacts are tripped open;

trip means cooperating with said operating means for tripping said operating means to the trip position;

automatic means cooperating with said trip means for sensing an electrical condition of said separable electrical contacts and engaging said trip means in response to a predetermined electrical condition of said separable electrical contacts;

manual means operatively associated with the opening of said housing and cooperating with said automatic means for engaging said automatic means, in order to engage said trip means, trip said operating means to the trip position, and trip open said separable electrical contacts; and wherein said automatic means includes movable armature means and magnetic means for sensing a current flowing between said separable electrical contacts and attracting the movable armature means in response to a predetermined current flowing through said separable electrical contacts, wherein the movable armature means and the magnetic means have a spacing therebetween whenever about zero current flows between said separable electrical contacts, and wherein said manual means also engages the movable armature means in order to set the spacing of the movable armature means to within about a generally predetermined spacing from the magnetic means.

3. The circuit breaker as recited in claim 1 wherein said trip means includes trip bar means which is generally transverse with respect to the longitudinal axis of the pushbutton means; wherein the movable armature is initially about parallel with respect to the longitudinal axis, the movable armature having an edge which is about transverse with respect to the longitudinal axis; and wherein the generally oblique surface of the engaging means engages the transverse edge of the movable armature in order to engage said trip bar means.

4. The circuit breaker as recited in claim 3 wherein movement of the pushbutton means along the longitudinal axis thereof moves the engaging means which engages the generally oblique surface thereof with the transverse edge of the movable armature in order to at least partially rotate the movable armature about the trip bar means which at least partially rotates in order to trip said operating means to the trip position.

5. The circuit breaker as recited in claim 1 wherein said manual means further includes spring means for biasing the pushbutton means away from the movable armature; and wherein the pushbutton means also has a surface which is about transverse with respect to the longitudinal axis of the pushbutton means, the spring means biased between the transverse surface of the pushbutton means and said housing.

6. The circuit breaker as recited in claim 1 wherein said manual means further includes spring means for biasing the pushbutton means away from the movable armature; and wherein the pushbutton means also has an arm disposed along the longitudinal axis thereof, the spring means biased between the arm of the pushbutton means and a surface of said housing.

7. The circuit breaker as recited in claim 5 wherein the transverse surface of the pushbutton means includes tab means; wherein the pushbutton means includes an arm disposed along the longitudinal axis thereof; and wherein the spring means has an end which is disposed between the tab means and the arm of the pushbutton means.

8. The circuit breaker as recited in claim 2 wherein the movable armature means is movable toward the magnetic means independent of said manual means in response to the predetermined current.

9. The circuit breaker as recited in claim 2 wherein said manual means includes pushbutton means having a longitudinal axis and engaging means for engaging the movable armature means; wherein the pushbutton means moves along the longitudinal axis thereof in order to further engage the movable armature means; and wherein the engaging means has a surface which is generally oblique with respect to the longitudinal axis, the oblique surface for engaging the movable armature means.

10. The circuit breaker as recited in claim 9 wherein said manual means further includes spring means for biasing the pushbutton means; and wherein the pushbutton means also has a surface which is about transverse with respect to the longitudinal axis of the pushbutton means, the spring means biased between the transverse surface of the pushbutton means and a surface of the magnetic means.

11. A circuit breaker, comprising:

a housing having an opening;

separable electrical contacts disposed within said housing and movable between a closed position and an open position;

operating means for moving said separable electrical contacts between the closed position and the open position, said operating means having a trip position wherein said separable electrical contacts are tripped open;

trip means cooperating with said operating means for tripping said operating means to the trip position;

automatic means cooperating with said trip means for sensing an electrical condition of said separable electrical contacts and engaging said trip means in response to a predetermined electrical condition of said separable electrical contacts;

manual means operatively associated with the opening of said housing and cooperating with said automatic means for engaging said automatic means, in order to engage said trip means, trip said operating means to the trip position, and trip open said separable electrical contacts; and wherein said automatic means includes a movable armature which engages said trip means; and wherein said manual means has a generally arcuate surface for engaging an edge of the movable armature.

12. A circuit breaker, comprising:

separable contact means moveable between a closed position and an open position;

operating means for moving said separable contact means between the closed position and the open position, said operating means having a trip position wherein said separable contact means is tripped open;

trip means cooperating with said operating means for tripping said operating means to the trip position;

automatic means cooperating with said trip means for sensing an electrical condition of said separable contact means, said automatic means including movable armature means for engaging said trip means in response to a predetermined electrical condition of said separable contact means;

manual means including pushbutton means and engaging means, the pushbutton means for manually moving the engaging means, the engaging means for engaging the armature means in order to engage said trip means, trip said operating means to the trip position, and trip open said separable contact means; and wherein the pushbutton means has a longitudinal axis, wherein the engaging means moves along the longitudinal axis of the pushbutton means in order to engage the armature means, and wherein the engaging means has a surface which is generally oblique with respect to the longitudinal axis, the oblique surface for engaging the armature means.

13. A circuit breaker, comprising:

separable contact means movable between a closed position and an open position;

operating means for moving said separable contact means between the closed position and the open position, said operating means having a trip position wherein said separable contact means is tripped open;

trip means cooperating with said operating means for tripping said operating means to the trip position;

automatic means cooperating with said trip means for sensing an electrical condition of said separable contact means, said automatic means including movable armature means for engaging said trip means in response to a predetermined electrical condition of said separable contact means;

manual means including pushbutton means and engaging means, the pushbutton means for manually moving the engaging means, the engaging means for engaging the armature means in order to engage said trip means, trip said operating means to the trip position, and trip open said separable contact means; and wherein the pushbutton means has a longitudinal axis, wherein said manual means further includes spring means for biasing the pushbutton means away from the armature means, and wherein the pushbutton means also has a surface which is about transverse with respect to the longitudinal axis of the pushbutton means, the spring means biased between the transverse surface of the pushbutton means and a surface of said automatic means.

14. A circuit breaker, comprising:

separable contact means moveable between a closed position and an open position;

operating means for moving said separable contact means between the closed position and the open position, said operating means having a trip position wherein said separable contact means is tripped open;

trip means cooperating with said operating means for tripping said operating means to the trip position;

automatic means cooperating with said trip means for sensing an electrical condition of said separable contact means, said automatic means including movable armature means for engaging said trip means in response to a predetermined electrical condition of said separable contact means;

manual means including pushbutton means and engaging means, the pushbutton means for manually moving the engaging means, the engaging means for engaging the armature means in order to engage said trip means, trip said operating means to the trip position, and trip open said separable contact means; and wherein the pushbutton means has a longitudinal axis, wherein the engaging means moves along the longitudinal axis of the pushbutton means, wherein the armature means includes a movable armature having an edge, and wherein the engaging means has a generally arcuate surface which engages the edge of the movable armature.

* * * * *